United States Patent [19]

Di Drusco et al.

[11] 4,211,737

[45] Jul. 8, 1980

[54] PROCESS FOR PRODUCING SYNTHETIC FIBERS FOR USE IN PAPER-MAKING

[75] Inventors: Giovanni Di Drusco, Milan; Deoscaride Zaffagnini, S. Biagio, both of Italy

[73] Assignee: Montedison S.p.A., Milan, Italy

[21] Appl. No.: 847,172

[22] Filed: Oct. 31, 1977

Related U.S. Application Data

[63] Continuation of Ser. No. 754,639, Dec. 27, 1976, abandoned, which is a continuation of Ser. No. 633,116, Nov. 18, 1975, abandoned.

[30] Foreign Application Priority Data

Nov. 19, 1974 [IT] Italy ..... 29594 A/74

[51] Int. Cl.[2] ..... B22D 23/08

[52] U.S. Cl. ..... 264/12; 162/157 R; 264/14; 264/140; 425/7

[58] Field of Search ..... 264/12, 140, 14; 162/157 R; 425/7

[56] References Cited

U.S. PATENT DOCUMENTS

| | | | |
|---|---|---|---|
| 2,297,726 | 10/1942 | Stephanoff | 264/12 |
| 2,317,875 | 9/1943 | Drell | 264/121 |
| 2,336,745 | 11/1943 | Mannings | 264/121 |
| 2,413,420 | 12/1946 | Stephanoff | 264/12 |
| 2,929,436 | 3/1950 | Hampshire | 264/121 |
| 3,785,918 | 1/1974 | Kawar et al. | 264/12 X |
| 3,794,731 | 2/1974 | Dannert et al. | 264/83 |
| 3,874,886 | 4/1975 | Levesque et al. | 264/12 |
| 3,885,014 | 5/1975 | Fukada et al. | 264/12 |
| 3,885,940 | 5/1975 | Levesque et al. | 264/12 |
| 4,001,357 | 1/1977 | Walz et al. | 264/12 |

*Primary Examiner*—Jay H. Woo

[57] ABSTRACT

There is disclosed an improvement in the production of microfibers or fibrils of synthetic thermoplastic polymeric materials by flash-spinning solutions, emulsions or suspensions of the synthetic polymers in solvents, under the action of a high-speed jet of gaseous or vaporous fluid having an angular direction with respect to the solution, emulsion or suspension being flash-spun. The improvement consists in causing the fluid jet to expand through a nozzle (or duct) of the convergent-divergent type and in extruding the polymer solution, emulsion or dispersion under flash conditions at an angle towards the fluid jet in expansion in the divergent portion of the nozzle.

7 Claims, 1 Drawing Figure

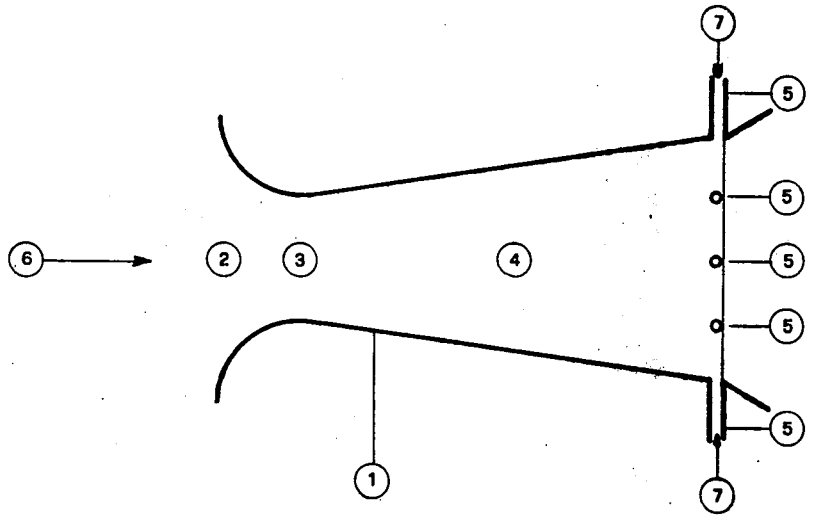
7
5
5
6
2
3
4
5
5
5
1
7

PROCESS FOR PRODUCING SYNTHETIC FIBERS FOR USE IN PAPER-MAKING

This is a continuation of Ser. No. 754,639 filed Dec. 27, 1976 and now abandoned, which is a continuation of Ser. No. 633,116, filed Nov. 18, 1975, and now abandoned.

THE PRIOR ART

Processes have been described for producing fibrids or fibrils of synthetic thermoplastic polymeric materials by flashspinning solutions, emulsions or suspensions of the polymeric materials under the action of a fluid in the gas or vapor phase and at high speed.

By "flash-spinning" is generally meant the process of extruding a solution, dispersion, emulsion or suspension of a thermoplastic polymer in a liquid medium through an orifice under pressure and temperature conditions such that instantaneous, or practically instantaneous, evaporation of the liquid medium occurs in the extrusion ambient, resulting in the precipitation of the polymer in the form of numerous fibrils connected to each other to form a more or less continuous tridimensional fibrous network having a surface area (specific area) greater than 1 $m^2/g$.

The flash-spinning of homogeneous solutions of thermoplastic polymers in organic solvents, of emulsions of the polymers in solvents and non-solvents (such as water), or of dispersions of the molten polymers in solvents and/or non-solvents are described, for instance, in British Pat. Nos. 891,943 and 1,262,531; in U.S. Pat. Nos. 3,402,231, 3,081,519, 3,227,784, 3,227,794, 3,770,856, 3,740,383 and 3,808,091; in Belgian Pat. No. 789,808, in French Pat. No. 2,176,858; and in German Patent Application No. 2,343,543.

According to a more recent method, described in pending application Ser. No. 606,453 now abandoned (filed as a continuation of application Ser. No. 335,335, filed Feb. 23, 1973, now abandoned) single fibrils of the kind described hereinabove are obtained directly by subjecting a solution of a polyolefin being extruded under "flash" conditions, to the disrupting action of a high-speed gaseous jet having an angular direction with respect to the direction of extrusion of the polyolefin solution.

An analogous process, but in which the starting material is a two-phase liquid mixture made up of a molten polymer and a solvent, is disclosed in British Pat. Nos. 1,355,912 and 1,355,913.

Finally, German Patent Application DOS No. 2,339,044 discloses a process for preparing fibrils which consists in extruding a polyolefin solution at high temperature and hitting the extruded solution by a fluid jet at an angle lower than 30° and at particular speed ratios.

Among the processes available so far for obtaining microfibers or fibrils of synthetic thermoplastic polymers for use in paper-making pulps, most suitable have proved to be the processes in which the extruded polymer composition is hit by a jet of gas or vapor disposed at an angle to the direction of extrusion of the polymer composition. This is both because of the simplicity of the apparatus required, and the possibility of utilizing those processes to obtain microfibers or fibrils of any thermoplastic polymer.

The possibility of using such process in commercial practice in order to obtain fibrous products which are morphologically suitable and competitive with cellulose fibers depends, essentially, on the proper use of the fluid jet in relation to the polymeric solutions, emulsions or dispersions employed. In this connection, several operating methods have been proposed, one of which is described in the above-mentioned pending application Ser. No. 606,453 and consists in using the fluid in the form of a jet coaxial with the nozzle through which the polymer solution is extruded.

Another method is suggested in the aforementioned British Pat. No. 1,355,913. It involves the use of two-phase polymer/solvent mixtures and consists in conveying the fluid into a duct comprising, in the order stated, a convergent portion, a narrow portion and, optionally, a divergent portion, extruding the two-phase mixture into either the convergent portion or the narrowed portion of the duct, and causing impact between the fluid jet and the two-phase mixture in either of those portions of the duct, depending on which is the portion into which the two-phase mixture is extruded.

The results of both the process of the pending application and of the British Patent are unsatisfactory from the economical point of view, due to the low yields of fibrous product obtained with respect to the consumption of fluid. The uneconomical aspects of those methods tends to increase when higher speeds of the fluid are employed, in particular when the fluid is steam, whereas it would be profitable to use the fluid at high speeds.

THE PRESENT INVENTION

One object of this invention is to provide an improved process for obtaining the microfibers or fibrils in which the fluid which hits the extruding polymeric material is used at high speed but which is free of the aforesaid disadvantages.

This and other objects are achieved by the present invention in accordance with which considerably improved yields of fibrous product made up of microfibers or fibrils having suitable characteristics, especially as regards homogeneity, by employing the fluid jet under particular conditions, are obtained.

The particular conditions consist in causing the fluid jet to expand through a nozzle or duct of the convergentdivergent type and in extruding a polymer solution, emulsion or dispersion in flash conditions at an angle toward the fluid jet in expansion in the divergent portion of the nozzle.

Thus, the invention provides a process for producing microfibers or fibrils of synthetic polymers for use in making paper according to conventional paper-making techniques, in which solutions, emulsions or dispersions of thermoplastic synthetic fiber-forming polymers in a liquid medium are extruded through a nozzle, under conditions such that instantaneous vaporization of the liquid medium occurs in the ambient of extrusion, and are impacted in said ambient of extrusion by a high-speed jet of gaseous fluid having an angular direction with respect to the direction of extrusion of the polymeric material, characterized in that the gaseous fluid is expanded initially through a nozzle of the convergent-divergent type and the polymeric material (solution, emulsion or dispersion) is extruded into the divergent portion of said nozzle.

In a presently preferred embodiment of the invention, the polymer in the liquid medium is extruded into the zone of the divergent portion of the convergent-divergent nozzle where the fluid jet reaches the maximum speed consistent with the thermodynamic conditions of the fluid upstream of the divergent portion of the nozzle.

Additional preferred conditions consist in expanding the gaseous fluid in such a way that it may reach its maximum speed at, or in proximity to, the terminal zone of the divergent portion of the nozzle, and in extruding the polymer solution, emulsion or dispersion into such terminal zone.

By the term "convergent-divergent nozzle", we mean any type of nozzle or pipe comprising, in the order stated, a convergent portion, a narrowed portion and a divergent portion. The section of the narrowed portion of such a nozzle is also defined as the "critical section" when a compressible fluid is expanded, the pressure in the narrowed portion ("critical pressure") being higher than the pressure existing downstream of the divergent portion of the nozzle.

An example of a nozzle of the convergent-divergent type, usually employed for bringing about the above-described conditions in a gaseous fluid, and which can be used also in the practice of this invention, is the nozzle known as a "De Laval" nozzle.

The present process can be used to obtain the microfibers of fibrils from homogeneous polymer solutions, as well as from dispersions, emulsions, suspensions and, in general, heterogeneous mixtures of polymer and liquid solvents and/or non-solvents.

While, for obtaining fibrils which are of more uniform and suitable dimensions, it is preferable to extrude the polymeric composition in proximity to the terminal section of the divergent portion of the nozzle, in practice the polymeric composition may be extruded into any section of said divergent portion.

For similar reasons, and as already mentioned, it is preferred to have the fluid jet, in proximity to the terminal section of the divergent portion of the nozzle, at the maximum speed attainable compatibly with its temperature and pressure conditions upstream of the narrowed nozzle portion. This can be achieved by suitably dimensioning the nozzle as a function of the initial thermodynamic state of the fluid utilized and of the downstream conditions.

The dimensions can be obtained by simple thermodynamic calculations or, optionally, by direct experiments, which is to say empirically.

By operating according to the modalities described herein, it is possible, among other things, to utilize the fluid jet at very high speeds, ranging from the velocity of sound in the critical section of the nozzle to values several times higher in the terminal portion thereof.

There is an optimum velocity of the fluid jet for each type of polymeric solution, emulsion or dispersion, depending on the polymer and the solvent or liquid carriers employed, as well as on the thermodynamic characteristics of the given solution, emulsion or dispersion.

Generally, it is preferable to use several extrusion nozzles for the polymer composition, circularly arranged around the divergent portion of the convergent-divergent nozzle for the gaseous fluid.

The accompanying drawing illustrates a device which can be used in practicing the invention. In the drawing, the jet of fluid runs, in the direction indicated by arrow (6) through convergent portion (2), narrowed portion (3) and divergent portion (4) of nozzle (1). The polymer composition is extruded through nozzles (5) in the direction indicated by arrow (7) and leading into the divergent portion (4) of nozzle (1). Nozzles (5) may have a uniform diameter or, although not necessarily, may have a larger diameter in proximity to divergent portion (4) in order to permit a partial expansion of the polymer composition before it is impacted by the fluid jet.

However, a surprising aspect of the improved process of this invention is that no preliminary expansion of the polymer solution, emulsion or dispersion is necessary for obtaining suitable fibrous products.

In the device illustrated in the drawing, nozzles (5) are arranged to form an angle of about 90° with respect to the longitudinal axis of nozzles (1). Nozzles (5) may also be arranged at a different angle with respect to said axis, the angle being preferably comprised between about 5° and about 90°.

Any gaseous or vaporous fluid may be used, such as those described in the above mentioned application Ser. No. 606,453, including the solvents or liquid media contained in the polymer composition being extruded, in vapor form, provided they are in such condition as to be at a temperature lower than the dissolution and/or softening temperature of the polymer/residual solvent system at the time they hit the extrudate.

Steam, and particularly dry steam, is preferably employed as the impacting fluid. N-hexane is an example of a solvent which, in the form of superheated steam, is advantageously utilized as the fluid jet.

The present process can be used to obtain the microfibers or fibrils from any fiber-forming, synthetic, thermoplastic polymer, such as homopolymers of olefins, acrylonitrile, acrylates, vinylchloride, vinylacetate, styrene, copolymers of such monomers with each other, and mixtures of such homopolymers and copolymers.

The following examples are given to illustrate the invention in more detail and are not intended to be limiting.

EXAMPLE 1

This example relates to the preparation of polyethylene fibrils starting from a solution of the polymer in n-hexane, using dry saturated steam as fluid and operating with a device of the kind shown in the drawing.

To this purpose, a solution containing 100 g of high density polyethylene (M.I.=4.5) for 1 liter of solution was used, at a temperature of 180° C. and at a pressure difference with respect to the outside of 14 atmospheres.

At the inlet of the nozzle's convergent portion the steam employed has a pressure of 18 $Kg/cm^2$ gauge and a temperature of 205° C. The steam flow-rate was 300 Kg/h.

The nozzle exhibited a circular narrowed section (critical) having a diameter of 6.5 mm, and a maximum (terminal) section, in the divergent portion, having a 15.42 mm diameter. The distance between the narrowed section and the terminal section was 31.8 mm.

Under these conditions the steam pressure, in proximity to the terminal section of the divergent portion, was slightly (i.e. few mmHg) higher than the atmospheric pressure, and the steam had the maximum speed consistent with its conditions upstream of the critical section, and equal to 900 m/sec. The steam expansion corresponded to an enthalpy drop of 115 Kcal/Kg.

The polymeric solution was fed, at a total flowrate of 960 Kg/h, through 8 cylindrical nozzles arranged symmetrically around the terminal section of the divergent portion of the convergent-divergent nozzle, each of them having a diameter of 2 mm.

After a 1-hour operation, 120 Kg of fibrils having a length between 3 and 4 mm, an apparent diameter of 40 microns and a surface area of 7 $m^2/g$ were obtained.

The steam consumption was 2.5 Kg per Kg of fibrils.

EXAMPLE 2

A solution of polyethylene in n-hexane like that of example 1, under the same temperature, pressure and hourly capacity conditions, was utilized.

Steam at a pressure of 2.7 $Kg/cm^2$ gauge, superheated up to a temperature of 200° C. and at a flowrate of 300 Kg/h was employed as fluid.

The device used was of the kind illustrated in the drawing, having a nozzle characterized by a critical section diameter of 7.3 mm and by a maximum section diameter, in the nozzle's divergent portion, of 8.7 mm, in which maximum section the steam was in the superheated state, at a pressure slightly higher than the atmospheric pressure and at its maximum velocity of 607 m/sec. The distance between minimum and maximum section was 22.4 mm. 8 nozzles for the extrusion of the polymeric solution, having a diameter of 2 mm, were used.

After a 1-hour operation, 120 Kg of fibrils having a length of 4–5 mm, an apparent diameter of 40 microns and a surface area of 8 $m^2/g$ were obtained; the steam consumption was 2.5 Kg per Kg of fibrils.

EXAMPLE 3

This example illustrates the preparation of fibrils starting from an emulsion formed by a solution of polypropylene in n-pentane and water. The polypropylene used had a M.I. = 10. The concentration of polypropylene in the emulsion was 50 g for 1 liter of emulsion. The weight ratio n-pentane/water in the emulsion was = 1.

The device used was of the kind shown in the drawing, having a nozzle for the fluid characterized by a critical section diameter of 11.5 mm, a terminal maximum section diameter, in the nozzle's divergent portion, of 15.7 mm, and by a distance between critical and maximum section of about 21 mm.

The emulsion was extruded, at a temperature of 155° C. and pressure of 21.4 $Kg/cm^2$ gauge, through 8 cylindrical nozzles arranged symmetrically around the terminal (maximum) section of the convergent-divergent nozzle, each of them having a diameter of 2 mm.

The emulsion was fed through the 8 cylindrical nozzles at a total flowrate of 2,200 Kg/h. The steam flowrate was 300 Kg/h. Dry saturated steam was used as fluid, having, at the inlet of the nozzle's convergent portion, a pressure of 6 $Kg/cm^2$ gauge and a temperature of 200° C.

Under these conditions the steam pressure, at the terminal section of the divergent portion of the nozzle, was slightly higher than the atmospheric pressure, and the steam was at its maximum speed consistent with its conditions upstream of the critical section, and equal to 715 m/sec.

After a 1-hour operation, about 150 Kg of fibrils having a length of 1.5–2.5 mm, mean (apparent) diameter of 20 microns and surface (specific) area of 4.1 $m^2/g$, were obtained.

The steam consumption was 2 Kg/Kg of fibrils.

EXAMPLE 4

This example illustrates the preparation of fibrils starting from a two-phase polymer composition, wherein one phase is formed by molten polyethylene (M.I. = 5) which contains liquid n-hexane, and the other phase is formed by liquid n-hexane which contains polyethylene in the dissolved state, the former phase being homogeneously dispersed into the latter phase. Such a twophase composition was obtained by heating a polyethylene solution in n-hexane, containing 100 g of polymer for 1 liter of solution, at a temperature of 200° C. and under a pressure of 17 $Kg/cm^2$ gauge.

Under such temperature and pressure conditions, the twophase composition is extruded through the 8 nozzles of the device described in Example 1, with a total flowrate of 1,200 Kg/h. Steam at a temperature of 205° C. and at a pressure of 18 $Kg/cm^2$ gauge at the inlet of the nozzle's convergent portion was used as fluid, at a flowrate of 300 Kg/h.

The pressure value of the steam at the terminal divergent portion of the nozzle, where impact with the extruded polymer composition occurred, was slightly higher than the atmospheric pressure, and the steam was at its maximum velocity of 900 m/sec.

After a 1-hour operation about 150 Kg of fibrils, having length of 2–2.5 mm, apparent diameter of about 25 microns and surface area of 8 $m^2/g$, were obtained.

The steam consumption was 2 Kg/Kg of fibrils.

What we claim is:

1. Process for preparing fibrils or microfibers of synthetic polymers, suitable for use in the manufacture of paper, in which solutions, emulsions or dispersions of fiber-forming thermoplastic polymers in a liquid medium are extruded through a nozzle under conditions such that instantaneous vaporization of the liquid medium occurs in the ambient of extrusion, and are caused to be impacted, in said ambient of extrusion, by a high-speed gaseous fluid jet having an angular direction with respect to the extrusion direction of such solution, emulsion or dispersion, characterized in that said fluid is initially made to expand through a convergent-divergent nozzle of the DeLaval type, and in that the polymeric solution, emulsion or dispersion is extruded into the divergent portion of such convergent-divergent nozzle.

2. The process according to claim 1, in which the polymeric solution, emulsion or dispersion is extruded at, or in proximity to, the terminal section of the divergent portion of the convergent-divergent nozzle of DeLaval type in which the fluid reaches the maximum speed compatible with its thermodynamic conditions upstream of the divergent portion of the nozzle.

3. The process according to claim 1, in which the polymeric solution, emulsion or dispersion is extruded through a number of nozzles arranged around the divergent portion of the nozzle through which the fluid runs.

4. The process according to claim 1, in which the gaseous fluid is dry steam.

5. The process according to claim 1, in which the gaseous fluid is n-hexane in the form of superheated steam.

6. The process according to claim 1, in which a solution, emulsion or dispersion of polyethylene is extruded into the divergent portion of the convergent-divergent nozzle of DeLaval type.

7. The process of claim 1, in which a solution, emulsion or dispersion of polypropylene is extruded into the divergent portion of the convergent-divergent nozzle of DeLaval type.

* * * * *